US009308630B2

(12) United States Patent
Chen et al.

(10) Patent No.: US 9,308,630 B2
(45) Date of Patent: Apr. 12, 2016

(54) IMPACT SCREWDRIVER

(71) Applicant: CHERVON INTELLECTUAL PROPERTY LIMITED, Road Town (VG)

(72) Inventors: Liang Chen, Nanjing (CN); Zhongxin Xu, Nanjing (CN)

(73) Assignee: CHERVON INTELLECTUAL PROPERTY LIMITED (VG)

( * ) Notice: Subject to any disclaimer, the term of this patent is extended or adjusted under 35 U.S.C. 154(b) by 0 days.

(21) Appl. No.: 14/565,837

(22) Filed: Dec. 10, 2014

(65) Prior Publication Data

US 2015/0174743 A1 Jun. 25, 2015

(30) Foreign Application Priority Data

Dec. 20, 2013 (CN) ..... 2013 1 0713648

(51) Int. Cl.

| | |
|---|---|
| ***B25B 21/02*** | (2006.01) |
| ***B25B 15/02*** | (2006.01) |
| *B25B 15/00* | (2006.01) |
| *B25B 17/00* | (2006.01) |

(52) U.S. Cl.

CPC ..... *B25B 21/02* (2013.01); *B25B 15/02* (2013.01); *B25B 15/00* (2013.01); *B25B 17/00* (2013.01)

(58) Field of Classification Search

CPC ..... B25B 21/00; B25B 21/02; B25B 15/00; B25B 15/02; B25B 15/04; B25B 17/00

USPC ..... 81/463, 464, 465, 466

See application file for complete search history.

(56) References Cited

U.S. PATENT DOCUMENTS

| | | | | |
|---|---|---|---|---|
| 6,926,095 | B2 * | 8/2005 | Chen | B23Q 5/027 173/114 |
| 7,494,437 | B2 * | 2/2009 | Chen | B25B 21/02 173/216 |
| 7,708,085 | B2 * | 5/2010 | DeCicco | B25B 21/00 173/176 |
| 7,723,953 | B2 * | 5/2010 | Roehm | B25B 21/00 320/114 |
| 8,122,971 | B2 * | 2/2012 | Whitmire | B25B 21/02 173/104 |
| 8,584,770 | B2 * | 11/2013 | Zhang | B25F 5/001 173/178 |
| 2007/0267207 | A1 * | 11/2007 | Ito | B25B 21/02 173/217 |
| 2011/0232930 | A1 * | 9/2011 | Zhang | B23Q 5/04 173/178 |
| 2012/0111592 | A1 * | 5/2012 | Limberg | B25B 21/026 173/48 |
| 2012/0118596 | A1 * | 5/2012 | Scott | B25B 21/026 173/98 |
| 2015/0083451 | A1 * | 3/2015 | Nishikawa | B25B 21/026 173/48 |

* cited by examiner

*Primary Examiner* — Hadi Shakeri
*Assistant Examiner* — Danny Hong
(74) *Attorney, Agent, or Firm* — Greenberg Traurig, LLP

(57) ABSTRACT

An impact screwdriver includes a housing, a battery arranged in the housing, an electric motor arranged inside the housing, a transmission part driven by the electric motor and an impacting part, the impacting part including a hammer, an anvil matched to and hammered by the hammer, and an output shaft revolved by the anvil, wherein the rated voltage of the battery is less than or equal to 4.25V, the impact frequency of the hammer and the anvil is at least 30 Hz, and the ratio of the output torque (Nm) of the output shaft to the rated voltage of the battery is 1.8~4.5.

9 Claims, 3 Drawing Sheets

IMPACT SCREWDRIVER

RELATED APPLICTION INFORMATION

This application claims the benefit of CN 201310713648.9, filed on Dec. 20, 2013, the disclosure of which is incorporated herein by reference in its entirety.

TECHNICAL FIELD

The present disclosure generally relates to a hand-held electric tool and, more particularly, to an impact screwdriver.

BACKGROUND

A screwdriver is a common household tool having the advantages of being quick and portable, cheap and practical, and widely usable. A common screwdriver usually cannot screw completely or may cause slip with overexertion in the process because of the constraints of output torque, which brings unnecessary duplications of effort or in the steps of switching manual tools to avoid slip and thus results in tedious work and poor user experience.

In this case, an impact screwdriver with an additional impact function is generally required, while tightening screws, an output shaft of the impact screwdriver applies an impact force on the screw with a predetermined frequency by the driving of a motor, to improve work efficiency. However, for DIY users, impact screwdrivers on the market are too expensive to be popular. In addition, because tools are used in different working conditions, common impact screwdrivers cannot be fully competent in narrow space because of the larger size, while small screwdrivers cannot meet demand because of the low voltage output torque.

The statements in this section merely provide background information related to the present disclosure and may not constitute prior art.

SUMMARY

The object of the present disclosure is to provide a compact impact screwdriver with low voltage and high output torque.

More particularly, the present disclosure describes an impact screwdriver, including a housing, a battery arranged in the housing, an electric motor arranged inside the housing, a transmission part driven by the electric motor and an impacting part, wherein the electric motor has a driving shaft to provide a rotational output, and the transmission part decelerates the rotational output of the driving shaft and then provides a rotational output, the impacting part comprising a hammer, an anvil matched and hammered by the hammer, and an output shaft revolved by the anvil, wherein the rated voltage of the battery is less than or equal to 4.25V, the impact frequency of the hammer and the anvil is greater than 30 Hz, and the ratio of the output torque (Nm) of the output shaft to the rated voltage of the battery is 1.8~4.5.

Further, the output torque of the output shaft may be at least 8 Nm.

Further, the rated voltage of the battery may be 3.6V.

Further, the hammer, the anvil and the output shaft of the impacting part may be powder metallurgical parts or precision castings, and the anvil and the output shaft may be capable of being integrated or independent parts separately formed.

Further, the impact screwdriver may also include a shaft locking mechanism capable of switching the impact screwdriver between an electric operation and a manual operation.

Further, the shaft locking mechanism may include an operating element mounted on the housing that is operatable between a locked position and an unlocked position, a first engaging element connected to the operating element, and a second engaging element arranged on the output shaft, wherein the first engaging element has a first position distal from the second engaging element and a second position at which the first engaging element is driven by the operating element to move and engage the second engaging element.

Further, the outer surface of the first engaging element may have a plurality of protrusions, a sliding slot may be provided on the housing for the axial movement of the first engaging element, and a plurality of grooves may be formed on the outer circumferential surface of the second engaging element to match with the protrusions.

Further, the operating element may be arranged to revolve around the housing, the outer surface of the first engaging element may have a chute in which a pin is arranged within which the pin is capable of sliding by the revolving of the operating element to force the axial movement of the first engaging element.

Further, the shaft locking mechanism may also include a shaft locking switch triggered by the operating element to control the on-off operation of the motor circuit.

Further, the battery may be a lithium battery.

An impact screwdriver constructed according to the present disclosure with fulfill the demands of low voltage and high output torque as well as being portable and compact for use in a narrow space.

Further areas of applicability will become apparent from the description provided herein. It should be understood that the description and specific examples are intended for purposes of illustration only and are not intended to limit the scope of the present disclosure.

Figure 1:
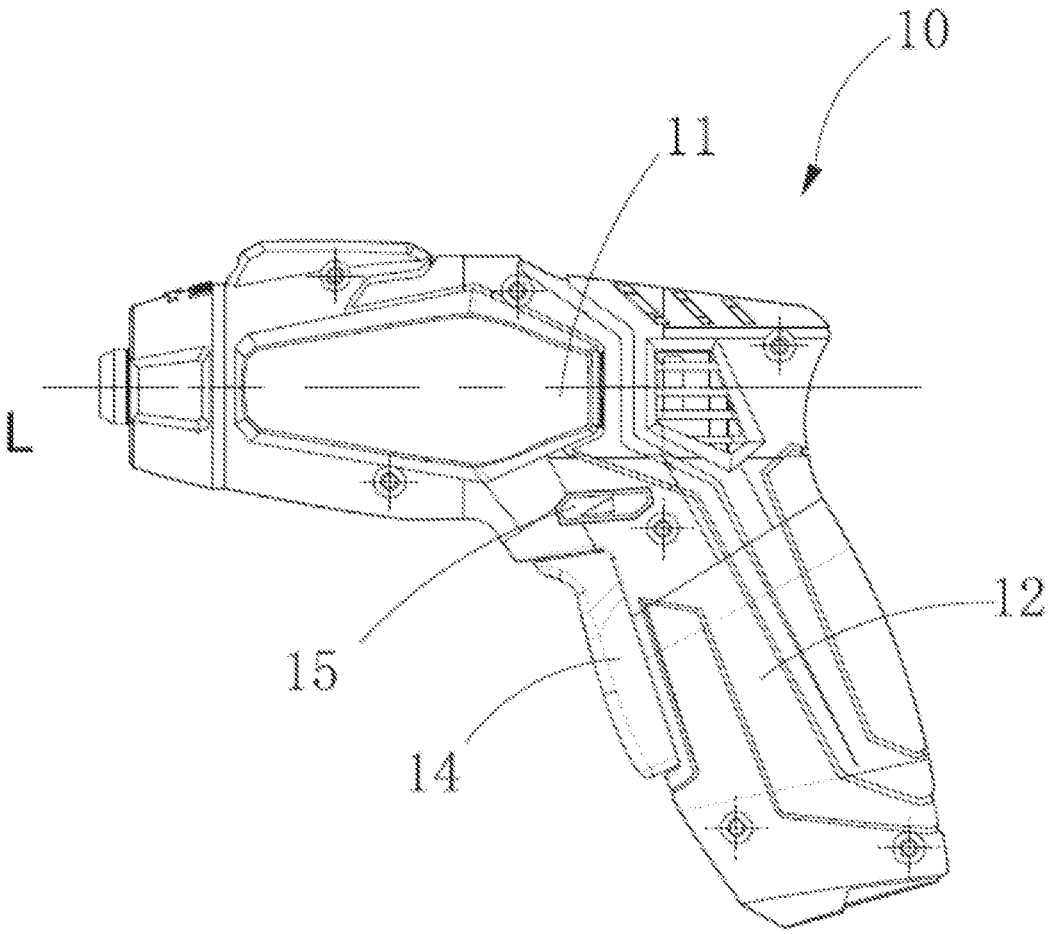
FIG. 1 is a front view of an exemplary impact screwdriver constructed according to the present disclosure.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

The following describes in detail an exemplary impact screwdriver with reference to the attached figures. The following description is intended to be merely exemplary in nature and is in no way intended to limit the claimed invention, its application, or uses.

Figure 2:
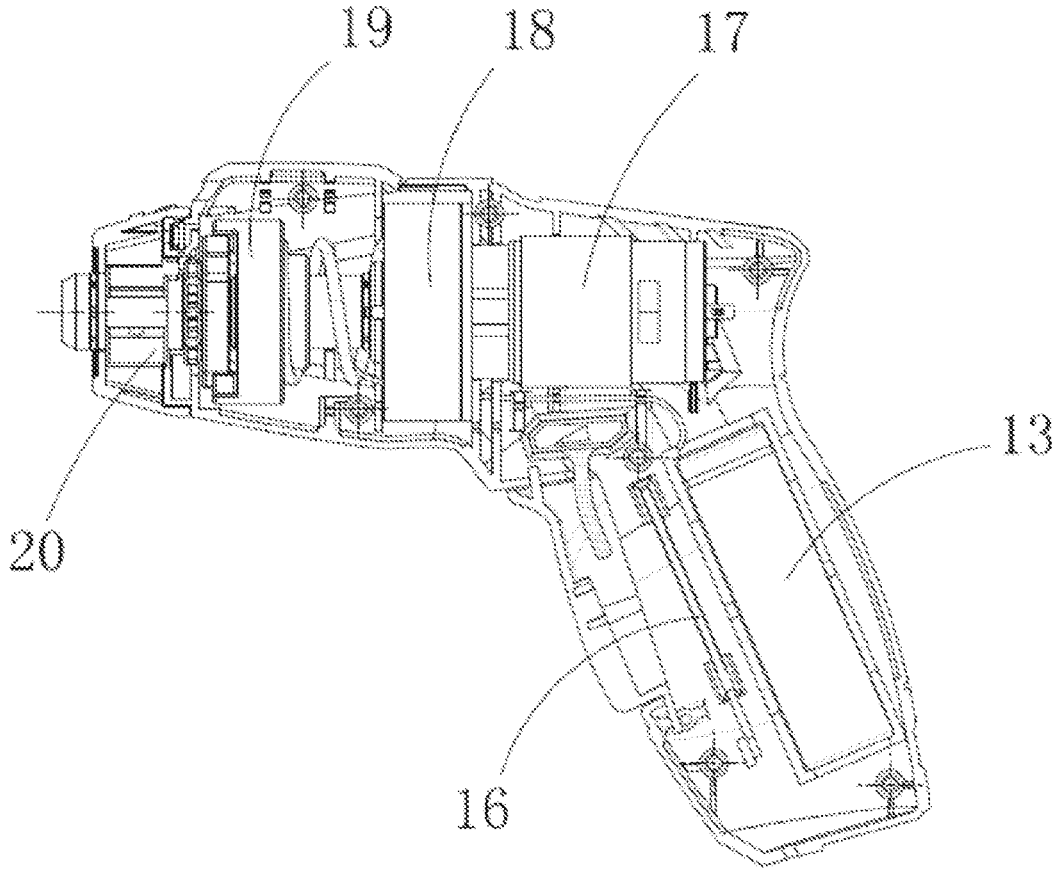
FIG. 2 is a cross-sectional view of the impact screwdriver of FIG. 1.
Figure 3:
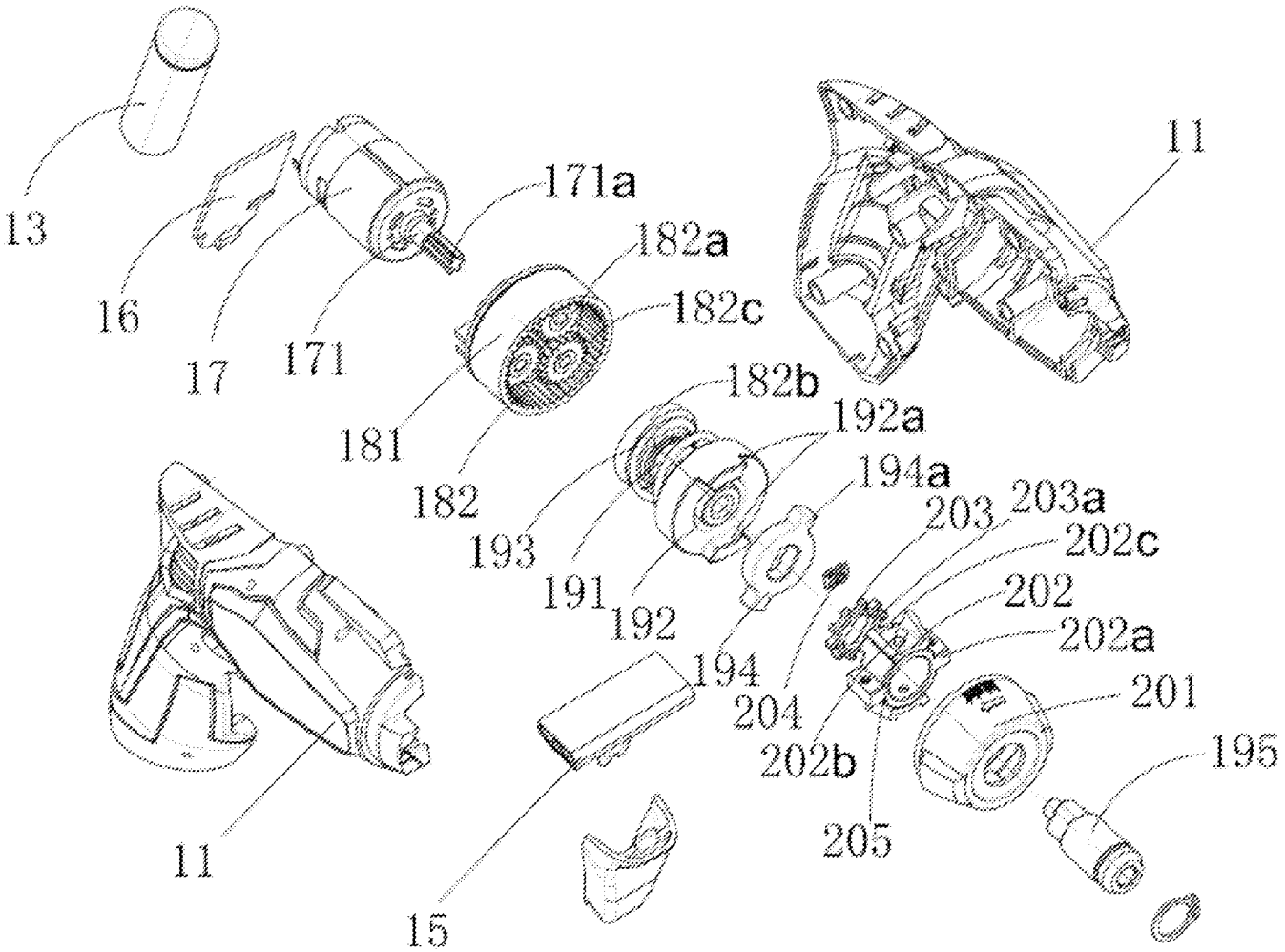
FIG. 3 is an exploded schematic view of the impact screwdriver of FIG. 1.

By reference to FIGS. 1-3, an exemplary impact screwdriver 10 is illustrated in the form of a tool having a shape that is similar to a pistol, and includes a housing 11 which has a substantially cylindrical part, a handle 12 arranged at an angle to the cylindrical part, and a battery 13 arranged inside the handle. The housing 3 has a longitudinal axis L along the length direction of the cylindrical part, a switch 14 is arranged on the handle 12 to control the machine to start, a reversing button 15 is arranged on the adjoining part of the handle 12 and the cylindrical part, which is arranged on the both sides of the housing to control the machine to reverse, a PCB control panel 16 in front of the battery 13 is arranged inside the handle, a power display interface may be integrated on the PCB control panel 16, which has a visual display of the charge and discharge process of the tool, additionally, a charge and discharge protection device is arranged in the machine, which protects the charge and discharge process of the whole machine, to ensure the safe operation and working life thereof.

By reference to FIG. 2 and FIG. 3, one end of the housing 11 which is distal from the handle 12 is taken as the front, the other end as the rear, and an electric motor 17, a transmission part 18 driven by the motor 17 and an impact part 19 are arranged in turn along the longitudinal axis L from the front to the rear. The electric motor 17 has a driving shaft 171 providing revolving output and a motor gear 171*a* for transferring the power from the revolving output of the electric motor 17 to the transmission part 18 via the gear structure which is arranged on the top of the driving shaft 171. The transmission part 18 decelerates the revolving output of the driving shaft 171 to provide a revolving output. The transmission part 18 includes a gearbox 181 which accommodates a planetary gear decelerating system 182. According to the embodiment of the present disclosure, the planetary gear decelerating system is a single-reduction system which includes planetary gears 182*a*, a planetary carrier 182*b* and a ring gear 182*c* fixedly arranged in the gearbox 181. The planetary carrier 182*b* includes a cylindrical base and a plurality of planet pins evenly spaced on the base surface in the circumferential direction, the planet pins extend from the rear end of the base, a planetary gear 182*a* is arranged on each planet pin, and the driving shaft 171 of the electric motor 17 extends into the gearbox 181 to engage the planetary gears 182*a* accommodated inside.

A hole is arranged on the base of the planetary carrier 182*b*, fixedly connected to the intermediate shaft 191 of the impacting part 19 via an interference fit, thus the intermediate shaft 191 always revolves around the planetary carrier 182*b*. The impacting part 19 includes a hammer 192 arranged on the intermediate shaft 191, a spring 193 disposed between the hammer 192 and the planetary carrier 182*b*, and a V-shaped groove impact mechanism located on the adjoining part of the hammer 192 and the intermediate shaft 191, and, since the V-shaped groove impact mechanism noted above is a known mechanism for providing impact, the functionality provided thereby need not be described in further detail herein. A pair of first end gears 192*a* are arranged on the radial symmetric protrusion of the front surface of the hammer 192, an anvil 194 is arranged in the front end of the hammer 192, and a pair of second end gears 194*a* are arranged on the radial symmetric protrusion of the rear end surface of the anvil 194 opposite to the hammer 192. The impacting part 19 further includes an output shaft 195 extending beyond the front of the gearbox 181 and connected to the anvil 194. It is understandable that the anvil 194 and the output shaft 195 may be integrated or independent parts separately formed. A slot 1951 is arranged in the front of the output shaft 195, which can receive corresponding working heads while realizing different functions.

Next, the working principle of the impact screwdriver 10 in the embodiment of the present disclosure will be explained in details. The revolving of driving shaft 171 of the electric motor 17 results in a corresponding rotation of the motor gear 171*a* on the driving shaft 171. This action results in the planetary gear 182*a* rotating around the planet pin, while the planetary gear 182*a* crawls along the annular inner tooth of the ring gear 182*c*, and revolves around the axis of the driving shaft 171. The planetary carrier 182*b* is rotated by the revolution of the planetary gear 182*a* , and transfers the rotation to the intermediate shaft 191. The hammer 192 driven by the intermediate shaft 191 reciprocates in the axial direction via the V-shaped groove impact mechanism, and impacts the anvil 194 under the influence of the spring 193, and finally the impact force is transferred to the output shaft 195 through the anvil 194.

The impact screwdriver 10 further includes a shaft locking mechanism 20 being capable of switching the impact screwdriver 10 between the electrical operation and the manual operation, the shaft locking mechanism 20 includes an operating element 201 mounted on the housing 11, a first engaging element 202 coupled to the operating element 201, and a second engaging element 203 arranged on the output shaft 195, and a shaft locking switch 204. The shaft locking mechanism may be operated between a locked position and a unlocked position and, when the operating element 201 is in the unlocked position, the first engaging element 202 is in a first position distal from the second engaging element 203, the output shaft 195 is unlocked, and the shaft locking switch 204 is not triggered, the electric motor 17 can be opened, the machine can work properly, and when the operating element 201 is in the locked position, the first engaging element 202 is driven by the operating element 201 to move to a second position and engage with the second engaging element, the output shaft 195 is locked, the shaft locking switch 204 is triggered, and the electric motor 17 cannot be powered. By locking of the output shaft 195, the impact screwdriver 10 is switched from the electrical screwdriver operating mode to the manual screwdriver operating mode, and the circuit of the electric motor 17 is controlled to be disconnected upon being locked, thus the rotation of the electric motor 17 is cut off, and the safety performance of the machine is improved.

Particularly, the operating element 201 is rotatably arranged in the front end of the housing 11 and the body of the operating element 201 forms a cup-shape, which includes an opening for the output shaft 195 to pass through. The output shaft 195 is kept in an axial location through a clamping ring. The first engaging element 202 has a plurality of protrusions 202*a* on the outer surface, accordingly, the housing 11 has a plurality of sliding slots in the front, the first engaging element 202 is axially and movably arranged in the sliding slots along the output shaft 195 via the protrusions 202*a*, a chute 202*b* is arranged on the outer surface of the first engaging element 202, the operating element 201 is fixedly connected to a pin 205 that is slidably movable in the chute 202*b*, the pin 205 causes the axial movement of the first engaging element 202 by the revolving of the operating element 201. In other embodiments, the operating element 201 may be fixedly connected to the first engaging element 202 or integrated, an opening chute is arranged on the upper side of the housing 11, in which the operating element 201 is movable along the axial direction, and the first engaging element 202 moves due to the axial movement of the operating element 201. A plurality of grooves 203*a* is formed on the outer circumferential surface of the second engaging element 203 to match with the protrusions 202*c* extended from the rear end of first engaging element 202. When the first engaging element moves axially to the position where the protrusions 202*a* are engaged with the grooves 203*a*, the output shaft is locked. The shaft lock switch 204 close to the operating element 201 along the axial direction is arranged in the front of the housing 11, a convex surface is arranged on the operating element 201. When rotating to the lock position, the convex surface triggers the shaft lock switch 204 to cut off the circuit of the electric motor 17. It can be understood that, in the above implementation of the output shaft 195, the second engaging element 203 and the output shaft 195 are two independent elements formed separately, or form an engaging structure on the output shaft 195 directly, by which the first engaging element 201 locks the output shaft 195 directly. Additionally, the shaft lock switch 204 of the shaft locking mechanism 20 is triggered in a mechanical manner, or the lock state of the output shaft is monitored directly by the PCB control panel 16, and can implement the on-off operation of the circuit in an electrical manner.

The ordinary screwdriver cannot be fully competent in the narrow space because of the larger size, while small screwdriver cannot meet user demands because of the low voltage output torque. In order to overcome the defects above, the battery's voltage and the performance parameters of the impact screwdriver need optimization, the battery used in the impact screwdriver 10 in the embodiment of the present disclosure is a built-in lithium battery. Because the voltage of a battery is usually proportional to the volume, the rated voltage of the battery is set to be less than or equal to 4.25v to reduce the volume, and a preferred range is between 3.6V to 4.2V. The rated voltage of the battery 13 used in the embodiment in the present disclosure is 3.6V, and forms an impact frequency greater than 30 Hz by the 20000 rpm of the electric motor, and a preferred impact frequency is between 35 Hz to 50 Hz; the output torque of the output shaft 195 is at least 8 Nm, and a preferred range is between 8 Nm to 16 Nm; the ratio of the output torque (Nm) of the output shaft 195 to the rated voltage of the battery is 1.8~4.5, and a preferred range is 1.8-4.3, and therefore the output with low voltage and the high output torque are realized.

The impact screwdriver 10 with the above parameters is smaller and more compact than an ordinary screwdriver, and it can be used in both ordinary scenes and narrow space, it is portable and can provide a higher output torque than an ordinary screwdriver, and it is equipped with the shaft locking mechanism 20 to switch between the electrical operation and the manual operation if necessary. Additionally, the elements of the impacting part, such as the hammer 192, the anvil 194 and the output shaft 195, utilize molded elements, for example, made of powder metallurgy materials or precision castings, which ensure strength while reducing the product's cost and make it more cost-effective.

The above illustrates and describes basic principles, main features and advantages of the present invention. Those skilled in the art should appreciate that the above embodiments do not limit the present invention in any form. Technical solutions obtained by equivalent substitution or equivalent variations all fall within the scope of the present invention.

What is claimed is:

1. An impact screwdriver comprising: a housing; a battery arranged in the housing; an electric motor arranged inside the housing; a transmission part driven by the electric motor, wherein the electric motor has a driving shaft to provide a first rotational output, and the transmission part decelerates the rotational output of the driving shaft and then provides a second rotational output; and an impacting part coupled to the transmission part comprising a hammer, an anvil matched to and hammered by the hammer, and an output shaft revolved by the anvil, wherein the rated voltage of the battery is 3.6V, the impact frequency of the hammer and the anvil is at least 30 Hz, and the ratio of the output torque (Nm) of the output shaft to the rated voltage of the battery is 1.8-4.5.

2. The impact screwdriver according to claim 1, wherein the output torque of the output shaft is at least 8 Nm.

3. The impact screwdriver according to claim 1, wherein the hammer, the anvil and the output shaft of the impacting part are at least one of powder metallurgical parts and precision castings, and the anvil and the output shaft are one of integrated or independent parts separately formed.

4. The impact screwdriver according to claim 1, wherein the impact screwdriver further comprises a shaft locking mechanism for switching the impact screwdriver between an electric operational mode and a manual operational mode.

5. The impact screwdriver according to claim 4, wherein the shaft locking mechanism comprises an operating element mounted on the housing that is operable between a locked position and an unlocked position, a first engaging element coupled to the operating element, and a second engaging element arranged on the output shaft; wherein the first engaging element has a first position distal from the second engaging element and a second position at which the first engaging element is driven by the operating element to move and engage the second engaging element.

6. The impact screwdriver according to claim 5, wherein the outer surface of the first engaging element has a plurality of protrusions, a sliding slot is provided on the housing for providing axial movement of the first engaging element, and a plurality of grooves are formed on the outer circumferential surface of the second engaging element to match with the protrusions.

7. The impact screwdriver according to claim 5, wherein the operating element revolves around the housing and the outer surface of the first engaging element is provided with a chute in which a pin is arranged for sliding movement by the revolving of the operating element to force the axial movement of the first engaging element.

8. The impact screwdriver according to claim 5, wherein the shaft locking mechanism further comprises a shaft locking switch triggered by the operating element to control an on-off operation of the motor circuit.

9. The impact screwdriver according to any one of claim 1, wherein the battery is a lithium battery.

* * * * *